US007896961B2

(12) United States Patent
Margaria et al.

(10) Patent No.: US 7,896,961 B2
(45) Date of Patent: Mar. 1, 2011

(54) PRODUCTS OF THE DRY-SPRAY TYPE, FOR THE PROTECTION OF CENTRIFUGAL CASTING MOLDS FOR CAST IRON PIPES

(75) Inventors: Thomas Margaria, Chambery (FR); Roland Siclari, Pompey (FR)

(73) Assignee: Pechiney Electrometallurgie, Chambery (FR)

( * ) Notice: Subject to any disclaimer, the term of this patent is extended or adjusted under 35 U.S.C. 154(b) by 233 days.

(21) Appl. No.: 11/794,723

(22) PCT Filed: Mar. 21, 2006

(86) PCT No.: PCT/FR2006/000609

§ 371 (c)(1), (2), (4) Date: Sep. 17, 2007

(87) PCT Pub. No.: WO2006/100375

PCT Pub. Date: Sep. 28, 2006

(65) Prior Publication Data

US 2008/0115691 A1 May 22, 2008

(30) Foreign Application Priority Data

Mar. 22, 2005 (FR) ..... 05 02811

(51) Int. Cl.
*B28B 7/36* (2006.01)

(52) U.S. Cl. ..... 106/38.22; 106/38.2

(58) Field of Classification Search ..... None
See application file for complete search history.

(56) References Cited

U.S. PATENT DOCUMENTS 3,597,260 A * 8/1971 Segura ..... 427/216
3,909,241 A * 9/1975 Cheney et al. ..... 75/255
4,058,153 A 11/1977 Pierrel
4,574,714 A * 3/1986 Bach et al. ..... 588/314
4,615,511 A * 10/1986 Sherwood ..... 266/208
4,711,741 A * 12/1987 Fujishima et al. ..... 252/188.28
5,610,230 A * 3/1997 Yoshida et al. ..... 524/730
5,989,304 A * 11/1999 Ozaki et al. ..... 75/252
6,139,600 A * 10/2000 Ozaki et al. ..... 75/255
6,338,753 B1 1/2002 Margaria et al.
6,503,445 B2 * 1/2003 Ozaki et al. ..... 419/64
6,677,095 B2 * 1/2004 Murota et al. ..... 430/108.3
2003/0010565 A1 * 1/2003 Brooks et al. ..... 181/116
2005/0066771 A1 3/2005 Margaria

FOREIGN PATENT DOCUMENTS

EP 177096 A1 * 4/1986
EP 0 930 113 A1 7/1999
FR 2 612 097 A1 9/1988
FR 2 835 209 A1 8/2003
JP 04370150 A * 12/1992

* cited by examiner

*Primary Examiner*—Melvin C Mayes
*Assistant Examiner*—Colin W Slifka
(74) *Attorney, Agent, or Firm*—Oliff & Berridge, PLC

(57) ABSTRACT

The invention concerns a powdery product, of the type known as dry spray, for protecting centrifuge casting molds of cast iron pipes, comprising the usual components for this type of use, as well as an adjuvant for improving the flowability characteristics of said product when it is being deposited and make them less dependent on its physical or physico-chemical characteristics. Said adjuvant can be in particular silicone oil, potassium siliconate or micro-silica of density less than 0.1 g/cm$^3$, as well as a mixture in any proportions of one or more of those.

17 Claims, No Drawings

PRODUCTS OF THE DRY-SPRAY TYPE, FOR THE PROTECTION OF CENTRIFUGAL CASTING MOLDS FOR CAST IRON PIPES

BACKGROUND OF THE INVENTION

The invention relates to a product in powder form, intended for protecting the casting molds used for the centrifugal casting of cast iron pipes; the casting molds used are commonly referred to by the name "shells".

DESCRIPTION OF THE PRIOR ART

Unless otherwise indicated, all the values relating to chemical compositions are expressed in percentages by weight.

The coatings used for protecting centrifugal casting shells for cast iron pipes may consist of inoculants and refractories in powder form, and also blends of silica and bentonite, these being put into place by spraying an aqueous suspension. Such coatings are described for example in U.S. Pat. No. 4,058,153 (Pont-A-Mousson) and are known as wet-spray coatings. It is also usual to employ powders sprayed dry onto the shell before the iron is cast, these powders then being referred to as dry-spray powders.

Whatever the technique employed for depositing them, these products are used for several purposes, in particular:

- to obtain a mold-release effect, that is to say making it easier to extract the pipe from the mold after solidification;
- to obtain a thermal barrier effect, limiting the temperature rise of the shell, thus contributing to an increase in its lifetime;
- to obtain an antipinhole effect, that is to say limiting the risk of pinholes appearing on the surface of the pipes; and
- to obtain an ultimate inoculating effect on the cast iron, so as to control the metallurgical structure of the pipe.

It is well known that insufficient inoculation in the iron results in the formation of carbides, considerable shrinkage upon cooling and rapid demolding, a gauge of high productivity. However, the castings thus obtained require a subsequent heat treatment, which may prove to be expensive.

It may, depending on the case, be preferable to inoculate further, even if this entails a reduction in the production rate, in order to avoid the final heat treatment, or on the contrary to inoculate less, in order to raise the productivity, and to subject the casting to heat treatment downstream.

The inoculability of the dry-spray product may therefore be positioned within quite broad limits; in contrast, the other required effects are subject to more constant requirements.

Products used as dry-spray products therefore generally consist of a blend of several components, including:

- an inoculant of relatively high effectiveness, which may typically constitute 30 to 100% of the product; for example, ferro-silicon alloys may be used for this purpose, these containing 0.1 to 4% aluminum and calcium and, optionally, other elements capable of introducing a supplementary or complementary metallurgical effect in the cast iron;
- powders of elements or alloys giving specifically an antipinhole effect; these may typically be the elements or alloys of the reducing elements of column 2 of the Periodic Table of Elements; and
- an inert mineral filler, for example silica, which may constitute up to 70% of the product.

Patent FR 2 612 097 (Foseco) in particular describes the use, as treatment agent, of alloys of the Fe—Si—Mg type, the particles of which are triboelectrically charged.

They are generally deposited on the shell, immediately before the iron is cast, by a delivery system, which in general comprises:

- one or more storage containers;
- an apparatus for defining the amount to be deposited and the moment of this deposition; and
- a system for transporting the powder right into the shell.

The products of the prior art have several drawbacks associated with the difficulty of obtaining a uniform distribution over the internal surface of the mold, this being manifested by excessive amounts in preferential regions and, conversely, lack or insufficient amounts of powder in other regions. One direct consequence of this is the creation of structural heterogeneities in the cast iron, and also surface defects on the cast pipe or product inclusions within this same pipe. Another consequence over time is nonuniform wear of the internal surface of the mold that the product has to protect, this having an impact on the surface of the cast iron pipe.

SUMMARY OF THE INVENTION

The subject of the invention is a powder product for protecting centrifugal casting molds for cast iron pipes by dry-spraying said product onto the internal surface of said mold, comprising an inoculating metal alloy or a blend of inoculating metal alloys, optionally powders of reducing elements or alloys having an antipinhole effect, and optionally an inert mineral filler, which product further includes at least one additive intended to improve the flowability characteristics of said powder product.

DESCRIPTION OF THE PREFERRED EMBODIMENTS

Preferably, the flowability is such that the flow time of 50 g of product via the 4 mm diameter hole of a funnel, the walls of which make an apex angle of 60 degrees, is between 17 and 27 seconds for a particle size distribution having a 300 μm undersize of between 99 and 100% and a 63 μm undersize of between 10 and 35%.

According to another preferred embodiment, the flow time, relative to the same product without said additive, is reduced by 5 to 10 s if said same product without said additive flows via the 4 mm diameter hole, and is between 20 and 27 s if said same product without said additive does not flow via said hole.

According to an advantageous embodiment, the additive is silicone oil, according to another embodiment it is potassium siliconate and according to yet another embodiment it is microsilica of density less than 0.1.

The additive may also be a blend in any proportions of one or more of the aforementioned additives.

Finally, according to a preferred embodiment, the proportion by weight of additive in said product is between 0.02 and 0.2%.

The products of the prior art used as dry-spray products in the manufacture of cast iron pipes by continuous centrifugal casting have a few drawbacks. In particular, the inert mineral filler added to the blend contributes to increasing the risks of fouling the molds and of forming inert mineral inclusions in the iron, which may result in the appearance of surface defects on the pipes.

The flowability of the powder must correspond to an optimum compromise between good capability of delivery and uniformity of distribution on the internal impression of the shell, and the need, after deposition on said impression, for the powder no longer to flow, in particular in front of the liquid iron front when said iron is poured into said shell. The latter also has, for this purpose, a hammered surface, consisting of a succession of cups, one of the purposes of which is to retain the powder so that it is not entrained by the liquid iron front. If the powder has too high a flowability, this precaution proves to be insufficient.

Moreover, the characteristics of the systems for handling, metering and delivering said powder differ from one user to another, with the result that, in practice, the characteristics of the powder and of the equipment are not always optimized one with respect to the other.

The choice of particle size distribution of said powder is also dictated in particular by requirements as regards its behavior during its interaction with the liquid iron in the shell so that it fulfils the abovementioned purposes.

Said powders, also called "inotubes" or "inopipes", are consequently fine and thus:

- they are very sensitive to the storage conditions, which may modify the flowability in the absolute and as regards its homogeneity during their end-use; and
- small variations in the manufacturing conditions (moisture, friability of the material, etc.) may also result in overall modifications and/or heterogeneities in their flowability.

The consequences of such a variation in the flowability are the following:

- since the ability of the cups, created by the abovementioned hammering of the shell surface, to retain the deposited coating is somewhat variable, said coating may exhibit irregularities. This defect may result in particular in the product slipping toward the bottom of the shell, which is generally inclined, typically by 6%; and
- these flowability variations may also have an influence on the powder delivery systems, causing various problems in use (blocking, plugging, etc.) and irregularities in deposition of the product on the shell, also causing irregularities in its associated effects.

These irregular effects result in various types of defects in the final cast iron product, such as: localized pinholes, excessively high carbide content in the thickness of the pipe, etc. A lack of product in certain regions of the shell for example will result in the local insufficiency of inoculation, with the presence of surface carbides and consequently abrasion and wear of the shell. Conversely, an excess of product will result in lack of dissolution by the iron, and consequently surface defects on the pipe that may lead to it being scrapped.

To alleviate these drawbacks, the Applicant therefore sought to improve the flowability of the powder in order to facilitate the operations preceding its deposition and the deposition itself, while avoiding the negative effects after the powder has been deposited in the shell, that is to say ensuring a low flowability when the iron is poured into said shell.

This result can be obtained thanks to additives that help to improve the cold flowability of the powder, that is to say up to the time it is deposited. A judicious choice of said additive makes it possible, when the powder is subsequently deposited on hot shells, which are typically at between 250 and 300° C., to nullify this increase in flowability, the temperature of the powder rising owing to its contact with the hot shell.

These additives, the effect of which is described in the following examples, may comprise potassium siliconate, but other additives having a similar behavior as regards their effect on flowability can also be used, such as for example silicone oil, microsilica with a density of typically less than 0.1 (the usual density for microsilica of "chemical" grade) or a blend, in any proportions, of one or more of these products. The trials described below were carried out with 0.06% additive, but the usual proportion under industrial conditions may be between 0.02 and 0.2%.

The particle size of the powder particle according to the invention is less than 580 μm and preferably less than 250 μm.

EXAMPLES

The flowability characteristics of a powder for "inotubes" were determined by various tests, including in particular the flow time, namely the time for a given quantity to flow through a standardized funnel, measurement of the shear-under-load properties and, in particular, using the method known as the "Jenike test", the flow time under load, which consists in measuring the maximum load under which the product can flow through a hole of given diameter, etc.

In the examples below, the flowability characteristics were determined by the flow time for 50 g of powder to flow through the 4 mm diameter hole of a funnel, the walls of which make an apex angle of 60 degrees.

In all cases, the particle size distribution had a 300 μm undersize between 99 and 100%.

The hierarchy of flow values thus obtained was the same if a test of the flow-under-load type, as mentioned above, were used.

Typically, said additives made it possible to obtain a flow time of the "inotube", the particle size distribution of which had a 63 μm undersize of 10 to 35%, between 17 and 27 s.

Example 1

A powder blend was prepared from the following constituents:

- 76% of ferro-silicon powder, containing 65.5% Si, 1.3% Ca and 0.95% Al, with a particle size of less than 300 μm;
- 4% of fluorspar powder, with a particle size of less than 150 μm; and
- 20% of calcium-silicon alloy powder, known as "CaSi" powder, containing 30.3% Ca, with a particle size of less than 300 μm.

The particle size distribution measurement showed that it had a 63 μm undersize of 23%.

The flow time was 28 s.

This product, used in "dry-spray" form as reference trial, gave satisfactory results: the pipes were practically free of pinholes—the few pinholes present were shallow and allowed the specification to be met; the carbide content was 8%; and a ferritic iron thickness of 35 μm on the external surface of the pipe was noted.

Example 2

The product described in example 1 was stored in cloth sacks, known as "big bags", under a shelter for two months.

After this storage:

- the particle size distribution measurement showed that it still had a 63 μm undersize of 23%; and
- the product did not flow through the 4 mm diameter hole.

This product, used as dry-spray product, gave inferior results: the pipes showed pinholes in many regions and the scrap rate was considerably larger than in example 1. The carbide content was 12% on average, but this was characterized by a larger scatter than in example 1. Consequently, the duration of the subsequent annealing, intended to absorb the carbides, had to be extended. No ferritic iron on the surface of the pipe was detected.

Example 3

The same powder blend as in example 1 was prepared, but with the addition, during the uniform blending operation, of 0.06% of a 40% potassium siliconate solution in water.

The particle size distribution measurement showed that it had a 63 μm undersize of 23%.

The flow time was 21 s.

This product, used as dry-spray product, gave very good results: the pipes were completely free of pinholes; the carbide content was 8%; and a ferritic iron thickness of 35 μm on the external surface of the pipe was noted.

Example 4

The product described in example 3 was stored in big bags under a shelter for two months.

After this storage:

the particle size distribution measurement showed that it still had a 63 μm undersize of 23%; and the flow time was 27 s.

This product, used as dry-spray product, gave satisfactory results: the pipes were practically free of pinholes—the few pinholes present were shallow and allowed the specification to be met; the carbide content was 10%; and a ferritic iron thickness of 35 μm on the external surface of the pipe was noted.

Example 5

A powder blend was prepared from the following constituents:

76% of ferro-silicon powder, containing 65.5% Si, 1.3% Ca and 0.95% Al, with a particle size of less than 300 μm;

4% of fluorspar powder, with a particle size of less than 150 μm; and

20% of Ca—Si powder, containing 30.3% Ca, with a particle size of less than 200 μm.

The particle size distribution measurement showed that it had a 63 μm undersize of 31%.

The flow time was 35 s.

This product, used as dry-spray product, gave somewhat unsatisfactory results: the pipes exhibited pinholes and in some cases did not meet the specification; the carbide content was 12%; and a ferritic iron thickness of 15 μm on the external surface of the pipe was noted.

Example 6

The same powder blend as in example 5 was prepared, but with the addition, during the uniform blending operation, of 0.06% of a 40% potassium siliconate solution in water.

The particle size distribution measurement showed that it had a 63 μm undersize of 31%.

The flow time was 25 s.

This product, used as dry-spray product, gave satisfactory results: the pipes were practically free of pinholes—the few pinholes present were shallow and allowed the specification to be met; the carbide content was 8%; and a ferritic iron thickness of 35 μm on the external surface of the pipe was noted.

It may be seen that, thanks to the additive, the flow time is reduced by 7 s and 10 s for the blends which, without additive, flowed through the 4 mm diameter hole (examples 3 and 6 compared with examples 1 and 5, respectively), and brought to 27 s in the case of a blend which, without additive, does not flow through said hole (example 4 compared with example 2).

More generally, it may be stated that this time is reduced by 5 to 10 s if the blend without additive flows through the 4 mm diameter hole and is between 20 and 27 s if the blend without additive does not flow through said hole.

Moreover, the additive makes the flowability characteristics of the product largely independent of its physical or physico-chemical characteristics, which may be seen in particular by comparison between the flow times before and after storage of the "inotubes" of examples 3 and 4, whereas the products without additive (examples 1 and 2) are appreciably sensitive thereto.

We claim:

1. A powder product for protecting centrifugal casting molds for cast iron pipes by dry-spraying said product onto the internal surface of said mold, comprising a blend that comprises:

an inoculating metal alloy or a blend of inoculating metal alloys present in the powder product and in an amount of up to 99.98% w/w, optionally a powder of reducing elements or alloys having an antipinhole effect, optionally an inert mineral filler, and at least one additive that improves the flowability characteristics of said powder product, wherein:

the additive is in an amount of from 0.02 to 0.2% w/w, and the additive is microsilica having a density of less than 0.1 g/cm$^3$.

2. The product as claimed in claim 1, wherein the flowability is such that a flow time of 50 g of product is between 17 and 27 seconds via a 4 mm diameter funnel hole having walls that make an apex angle of 60 degrees, and said powder product has a particle size distribution having a 300 μm undersize of between 99 and 100% and a 63 μm undersize of between 10 and 35%.

3. The product as claimed in claim 2, wherein the flowability is such that the flow time, relative to the same product without said additive, is reduced by 5 to 10 s when said same product without said additive flows via the 4 mm diameter hole, and is between 20 and 27 s when said same product without said additive does not flow via said hole.

4. The product as claimed in claim 1, wherein the inert mineral filler comprises silica.

5. The product as claimed in claim 1, wherein the inert mineral filler comprises CaSi.

6. The product as claimed in claim 1, wherein the inoculating alloy or blend of inoculating alloys comprises at least one ferro-silicium type alloy.

7. The product as claimed in claim 1, wherein the inoculating alloy or blend of inoculating alloys comprises at least one of aluminum and calcium in an amount of from 0.1 to 4% w/w.

8. The product as claimed in claim 1, wherein said product has a particle size distribution lower than 580 μm.

9. The product as claimed in claim 1, wherein said product has a particle size distribution lower than 250 μm.

10. The product as claimed in claim 1, wherein the powder having an antipinhole effect comprises fluorspar.

11. The product as claimed in claim 1, wherein the inoculating metal alloy or the blend of inoculating metal alloys is in an amount of from 19.8 to 99.98% w/w.

12. The product as claimed in claim 1, wherein the inoculating metal alloy or the blend of inoculating metal alloys is in an amount of from 25.8 to 99.98% w/w.

13. The product as claimed in claim 1, wherein the inoculating metal alloy or the blend of inoculating metal alloys is in an amount of from 30 to 99.98% w/w.

14. The product as claimed in claim 1, wherein the powders having an antipinhole effect are in an amount of up to 10% w/w.

15. The product as claimed in claim 1, wherein the inert mineral filler is in an amount of up to 70% w/w.

16. The product as claimed in claim 1, wherein the inoculating metal alloy or the blend of inoculating metal alloys is in an amount of from 75 to 99.98% w/w.

17. A powder product for protecting centrifugal casting molds for cast iron pipes by dry-spraying said product onto the internal surface of said mold, comprising a blend that comprises:

an inoculating metal alloy or a blend of inoculating metal alloys present in the powder product and in an amount of up to 99.98% w/w, a powder of reducing elements or alloys having an antipinhole effect, optionally an inert mineral filler, and at least one additive that improves the flowability characteristics of said powder product, wherein:

the additive is in an amount of from 0.02 to 0.2% w/w, and the additive is microsilica having a density of less than 0.1 g/cm$^3$.

* * * * *